US008065946B2

(12) United States Patent
Weber et al.

(10) Patent No.: US 8,065,946 B2
(45) Date of Patent: Nov. 29, 2011

(54) COMPOSITE ARMOR ELEMENT AND EFFECTIVE BODY ELEMENT

(75) Inventors: Jürgen Weber, Brühl (DE); Robert Bayer, Friedberg (DE); Norbert Keil, Dachau (DE); Stefan Schiele, Augsburg (DE)

(73) Assignee: Krauss-Maffei Wegmann GmbH & Co. (DE)

( * ) Notice: Subject to any disclaimer, the term of this patent is extended or adjusted under 35 U.S.C. 154(b) by 199 days.

(21) Appl. No.: 12/513,153

(22) PCT Filed: Oct. 24, 2007

(86) PCT No.: PCT/DE2007/001921

§ 371 (c)(1),
(2), (4) Date: Apr. 30, 2009

(87) PCT Pub. No.: WO2008/055468

PCT Pub. Date: May 15, 2008

(65) Prior Publication Data

US 2010/0071537 A1 Mar. 25, 2010

(30) Foreign Application Priority Data

Nov. 10, 2006 (DE) ..... 10 2006 053 047

(51) Int. Cl.
*F41H 5/04* (2006.01)

(52) U.S. Cl. ..... 89/36.02; 89/904; 89/906; 89/910; 89/914

(58) Field of Classification Search ..... 89/36.01, 89/36.02, 36.04, 36.05; 428/911
See application file for complete search history.

(56) References Cited

U.S. PATENT DOCUMENTS

| | | | | |
|---|---|---|---|---|
| 1,815,187 | A | 7/1931 | Coles | |
| 3,431,818 | A * | 3/1969 | King | 89/36.02 |
| 4,179,979 | A | 12/1979 | Cook et al. | |
| 4,534,266 | A | 8/1985 | Huet | |
| 4,945,814 | A | 8/1990 | Huet | |
| 5,738,925 | A | 4/1998 | Chaput | |
| 5,824,940 | A | 10/1998 | Chediak et al. | |
| 6,601,497 | B2 | 8/2003 | Ghiorse et al. | |
| 2002/0178900 | A1 * | 12/2002 | Ghiorse et al. | 89/36.02 |
| 2004/0083880 | A1 * | 5/2004 | Cohen | 89/36.02 |

FOREIGN PATENT DOCUMENTS

| | | |
|---|---|---|
| EP | 1071916 | 5/2003 |
| EP | 1383101 | 11/2003 |

* cited by examiner

*Primary Examiner* — Bret Hayes
(74) *Attorney, Agent, or Firm* — Robert W. Becker; Robert Becker & Associates

(57) ABSTRACT

A composite armor element for protection against projectiles. At least one layer of effective bodies is disposed in rows next to one another in the composite armor element, the effective bodies being embedded in a matrix material. The effective bodies of one row are fixedly interconnected at least partially by means of webs to form a chain which is a monolithic element. An effective body element for insertion in a composite armor element comprises at least two effective bodies fixedly interconnected by at least one web to form a chain. The effective body element is a monolithic element, and a plurality of effective body elements are embedded in a matrix material.

32 Claims, 8 Drawing Sheets

COMPOSITE ARMOR ELEMENT AND EFFECTIVE BODY ELEMENT

BACKGROUND OF THE INVENTION

The instant application should be granted the priority dates of Nov. 10, 2005, the filing date of the corresponding German patent application 10 2006 053 047.0, as well as Oct. 24, 2007, the filing date of the International patent application PCT/DE200/001921.

The present invention relates to a composite armor element for protection against projectiles or missiles, as well as an effective body element for insertion in a composite armor element.

Composite armor elements, such a composite armor plates or composite armor mats, which are comprised of a composite of several materials, are known. Frequently, composite armor elements are constructed in such a way that filler material or active or effective bodies are introduced between two, for example plate-shaped, elements, with a matrix material that is capable of being cast, for example polymeric materials or metals, subsequently being cast about the effective bodies.

The plates are frequently provided with end layers. The manufactured composite armor plates can have thick composite fiber layers glued to their back side, thus forming self-supporting armor elements, or they can be applied to metallic vehicle housings, such as a welded steel pan, whereby they achieve the complete protection effect together with the housing structure. It is additionally known to dispose shock-dampening materials between the effective bodies so that the effective bodies do not rest directly against one another in a disadvantageous manner.

DE 1 578 324 describes a composite armor plate, whereby individual balls or cylinders made of a hard ceramic material are utilized as active or effective bodies. The cylinders are disposed in rows in the plate in a plurality of uninterrupted layers or plies, i.e. their longitudinal axes are disposed essentially parallel to the plane of the plate and parallel to one another, whereby the cylinders of one layer are offset relative to the cylinders of the other layer. The cylinders are furthermore spaced from one another, whereby a plurality of layers of a spacing material are used in such a way that each layer of spacing material is alternatingly wound above or below the cylinders in their pertaining layer.

EP 1 071 916 B1 describes a composite armor plate having individual cylindrical ceramic effective bodies, whereby the space between the effective bodies is filled with triangular or hexagonal intermediate space pellets that are adapted to the shape.

EP 1 363 101 A1 describes a composite armor plate, whereby the individual active bodies are provided with a band to reduce the overall weight of the plate.

The drawback of the known plates is that the manufacture is expensive and imprecise due to the large number of the small effective bodes as well as the insertion of shock-dampening materials.

It is an object of the present invention to improve the aforementioned drawbacks.

SUMMARY OF THE INVENTION

The composite armor element of the present application is provided with at least one layer of effective bodies disposed in rows next to one another in the composite armor element, wherein the effective bodies are embedded in a matrix material, further wherein the affective bodies of a given row of effective bodies are fixedly interconnected at least partially my means of respective webs to form a chain, and wherein the chains of effective bodies are a monolithic element. The effective body element of the present application for insertion in a composite armor element comprises at least two effective bodies, which are respectively fixedly interconnected by at least one web to form a chain, wherein the effective body element is a monolithic element, and wherein a plurality of effective body elements are embedded in a matrix material.

It is a basic concept of the present invention to connect the effective bodies via, in particular, short and narrow webs to form long rows, and thus to provided easy-to-manufacture effective body elements, designated as effective body chains. Within the framework of the manufacture of the composite armor element, these are easier to handle, since due to the reduction of the number of parts considerably fewer operating steps are required. In addition, it is no longer necessary to introduce shock-dampening materials between the effective bodies, since the webs ensure a minimal gap between the effective bodies and hence a shock-dampening by means of the webs or the matrix material in the gaps between the effective bodies is effected.

The individual effective bodies of an effective body element can be produced from extra hard materials, in particular ceramic, metallic, sintered or fiber materials, with relative to the plate dimensions smaller dimensions. They can be cylindrical, spherical or tetrahedral, or can have a rod-shaped configuration with a polygonal cross-section. The end faces can be linear, convex, conical, angular, or inclined. The effective bodies preferably have at least in part a ratio between height and maximum width extension that is greater than 0.8. The effective bodies are preferably oriented parallel to one another. Furthermore, an upright arrangement of the effective bodies in the composite armor element is preferred, whereby, however, a horizontal or an inclined arrangement is also usable. The effective bodies of one layer can be offset relative to the effective bodies of an adjacent layer. In the same manner, the effective bodies of one row can be offset relative to the effective bodies of an adjacent row.

The webs have prescribed dimensions, whereby the extension in the radial direction relative to a rod-shaped or cylindrical effective body is designated as the web length. The extension of the web in an axial direction is designated as the web height. The extension that lies in a direction tangential to the outer surface of a cylindrical effective body is designated as the web width.

Two or more webs can also be used between two effective bodies. In this way, the stability of the effective bodies can be improved, thus reducing the risks that the chains unintentionally break during manufacture, transport or processing.

As a consequence of the joining together of the effective bodies by means of webs, chain-like effective body elements result that contain a plurality of individual effective bodies. Relative to the main dimensions of the effective bodies, the webs can have a lesser length and/or a lesser width, i.e. can be short and/or narrow. The web height can be in the range of the height of the effective bodies. The number of connected effective bodies can vary as desired, and is preferably in the range of 5-20. The webs should have an adequate stability in order to enable a reliable handling during manufacture. On the other hand, it can be advantageous to embody the webs in such a way that during the manufacture of a composite armor element, the chain can be broken or divided manually or with a machine in order to obtain the correct length. Pursuant to one preferred embodiment, the ratio of the minimum web width to the maximum main dimension of the effective body cross-section is less than 0.4. Furthermore, the web can be provided with a break notch, so that during the placement of the effective body chains in the composite armor element, shorter effective body chains can be broken off, for example if this is necessary at the edge of the composite armor element ("Toblerone-principle"). In this way, the manufacture can be simplified.

The geometry of the webs can be linear or can have a rounded-off portion; furthermore, a notch can be provided on one side or on several sides. The notch width can extend over the entire web length, and the notch angle can be in the range of between 40° and 100°. Furthermore, the ratio of the web width at the notch base and the web length can be in the range of from 0.3 to 2.5.

The webs can be comprised of polymeric materials, in particular elastomers, or of soft metals. They are fixedly connected with the effective bodies, and can be provided with adhesive compounds or can be formed entirely or partially as an integral part of effective bodies. Pursuant to one particularly advantageous embodiment of the invention, the effective body chains are manufactured monolithically, i.e. as a single piece, so that rigid, "standard formed" effective body chains result. Thus, no individual effective bodies are any longer produced; rather, entire effective body chains are produced in a single operation, with the webs being comprised of the same material as the effective body. In this connection, the shock-dampening is realized by the described formation of the web regions.

If the composite armor element is struck by an armor-piercing hardened-core projectile, the projectile core is broken up and destroyed upon striking a very hard effective body. In so doing, the struck effective body is also entirely destroyed, and the end layer or also the wall of the vehicle structure absorbs the remainder of the impulse, so that no penetration into the interior space that is to be protected takes place. Due to the high local energy entry, pronounced shock waves occur with this process that where the adjacent effective body rests directly upon the struck body are transmitted to this adjacent effective body and also destroy it, even though it was not struck directly. This would be transferred to further adjoining effective bodies, and a larger damaged region would result that would no longer be safe for a subsequent round or strike. The inventive webs dampen the transfer of the shock waves by use of the described materials or by the use of the described configuration of the thin webs or the provision of special notches. The radii of destruction when a direct hit occurs are thus minimized, and a good "multi-hit-capability" results; in other words, the protective function is maintained even after a number of closely spaced together, successive direct hits.

The chain-like effective body elements can be placed in straight rows within one layer in the composite armor plate. However, they can also be zig-zag shaped or looped. Multi-row effective body matrices can also be used that in particular can be monolithically produced and that can be divided as desired during the manufacture of the composite armor element.

After the assembly process, the arrangement of the effective body chains is embedded into the matrix material, in particular polymeric materials such as polyurethane, epoxy resin, polyester or rubber, and can be closed off on the front side by means of a protective layer. The other side can be comprised of layers produced of materials having shock-absorbing properties, whereby in addition a high tensile strength should exist. The composite armor element can be mounted in a self-supporting manner in a frame construction, or can be mounted on a structure housing of armored steel or light metal, whereby an intermediate air layer or shock-absorbing intermediate layers can be provided.

The invention is not limited to using only identical geometries and materials within a composite armor element. Rather, the invention also includes combinations of the described materials and geometries.

A particularly straightforward manufacture can be achieved if during the manufacture the chain-like effective body elements are placed in a case that is produced in particular in an accurately dimensioned manner and of steel, light metal, polymeric material or fiber composite material, and is then cast or vulcanized with a matrix material. In this situation, the case becomes an integral part of the protection module, and can represent the outer layer or boundary thereof. The effective body chains can also be placed in an in particular accurately dimensioned manufacturing mold or in a manufacturing molding box, and can then be cast or vulcanized with the matrix material.

BRIEF DESCRIPTION OF THE DRAWINGS

Embodiments of the invention are described with the aid of FIGS. 1 to 9, which show.

DESCRIPTION OF SPECIFIC EMBODIMENTS

Figure 1A:
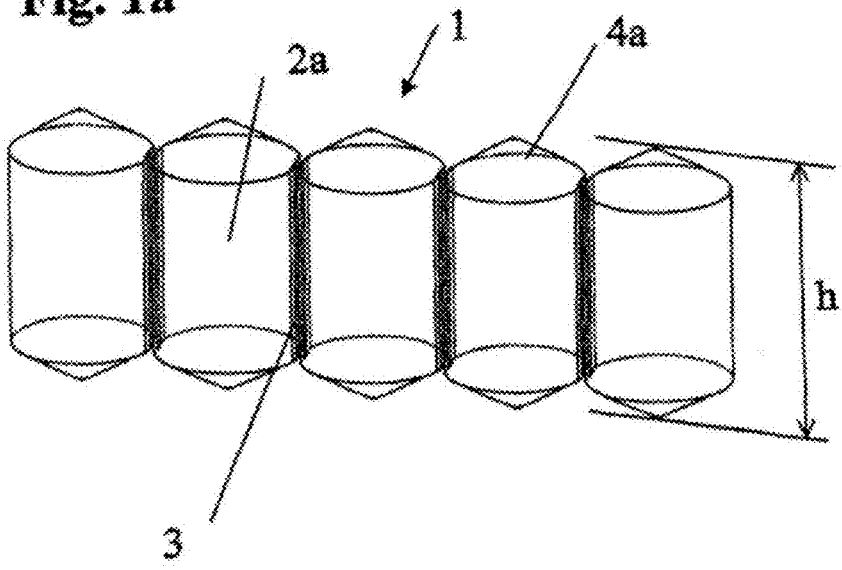
FIG. 1*a* a chain-like effective body element in an isometric illustration.
Figure 1B:
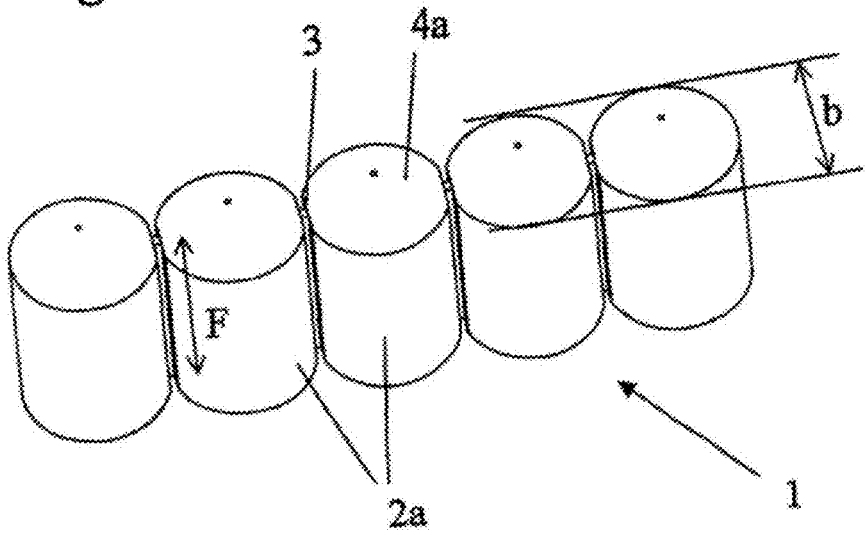
FIG. 1*b* the effective body element of FIG. 1*a* from a different perspective.
Figure 2:
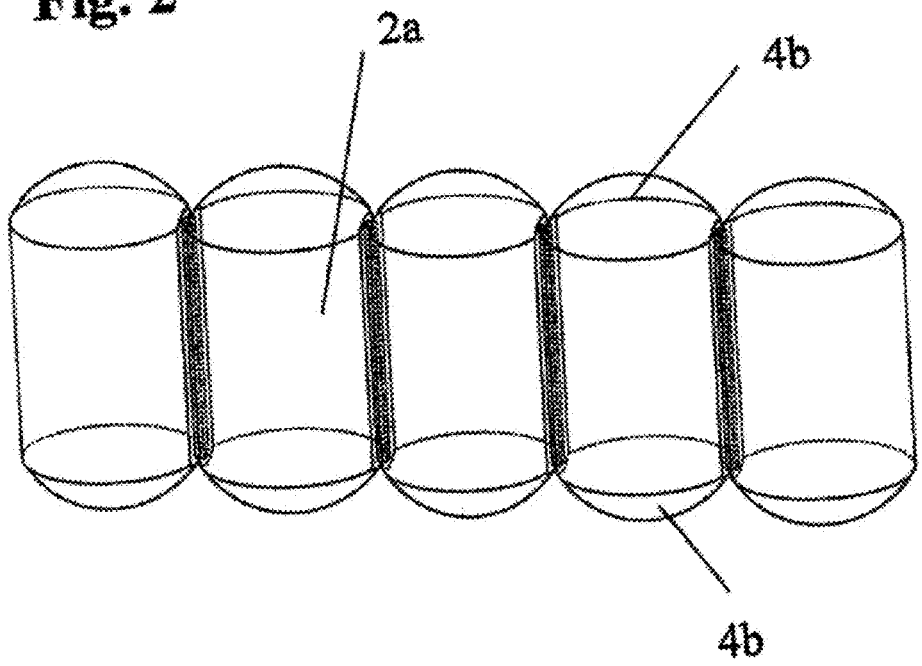
FIG. 2: the effective body element of FIG. 1 with altered end faces.

FIGS. 1*a* and 1*b* show an active or effective body chain 1 as an active or effective body element, which is composed of individual ceramic active or effective bodies 2*a* having the same geometry; these effective bodies are rigidly or fixedly interconnected by means of linear webs or fins 3. The effective body chain 1 is manufactured monolithically, i.e. as a single piece, so that the webs 3 are comprised of the same material as are the effective bodies 2*a*. The effective bodies 2*a*, which have a height h, have a cylindrical fundamental shape with an essentially circular cross-section having the diameter b. The end faces are embodied as cones 4*a* having rounded apexes. FIG. 2 illustrates an effective body chain with which the end faces are curved or bulged convexly outwardly, as shown at 4*b*. The effective bodies 2, 2*a*, 2*b* are comprised at least partially of ceramic materials, in particular at least partially of aluminum oxide ceramic having an $Al_2O_3$ content of 92%-99.99%. Further, the effective bodies 2, 2*a*, 2*b* are comprised at least partially of boron carbide, silicon carbide, silicon nitrite or titanium triborate, or at least partially of sintered materials or of metallic materials, in particular of hardened steel, aluminum or titanium. The matrix material is made up of one or more polymeric materials, in particular polyurethane, epoxy resin, polyester, rubber or other elastomers.

Figure 3:
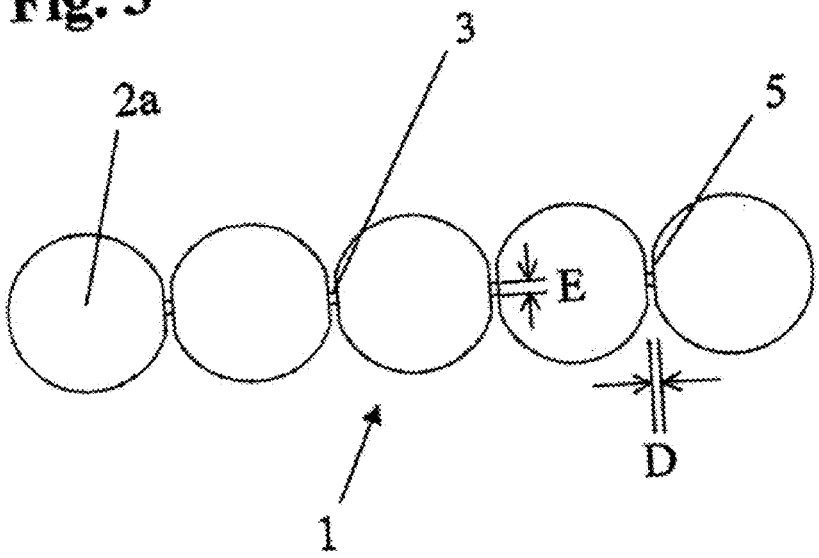
FIG. 3 a plan view onto the effective body element of FIG. 2.

As a consequence of the webs 3, a prescribed spacing exists between the individual effective bodies 2*a*. As can be seen in FIG. 3, the essentially circular cross-section is provided in the region of the web 3 with a side cut or cutout 5. The configuration of the effective body chain is such that the center points of the identical circular cross-sectional surfaces are spaced apart exactly by a distance that corresponds to the diameter of the circle. In other words, in the region of the webs 3 the effective bodies have cutouts 5 that correspond to half of the web width length D.

The webs 3 have a constant web width E and web length D, which have approximately the same dimensions and are significantly less than the web height F (see FIG. 1*b*). It can furthermore be seen that the ratio of the minimum web width E to the maximum main diameter of the effective body cross-section b is less than 0.4. The effective bodies (2, 2*a*) are provided at least partially in the region of the web connection with cutouts that correspond to half of the web length (D).

Figure 4:
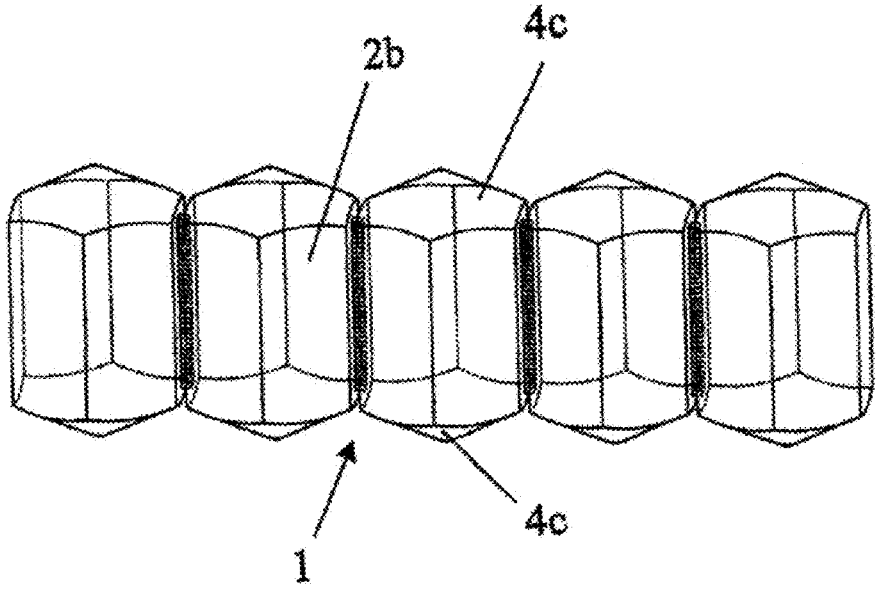
FIG. 4 a further embodiment of an effective body element.

FIG. 4 shows an effective body chain 1 according to which the individual effective bodies 2*b* have a hexagonal cross-sectional sectional surface. The end faces 4*c* have a pyramid-shaped configuration.

Figure 5:
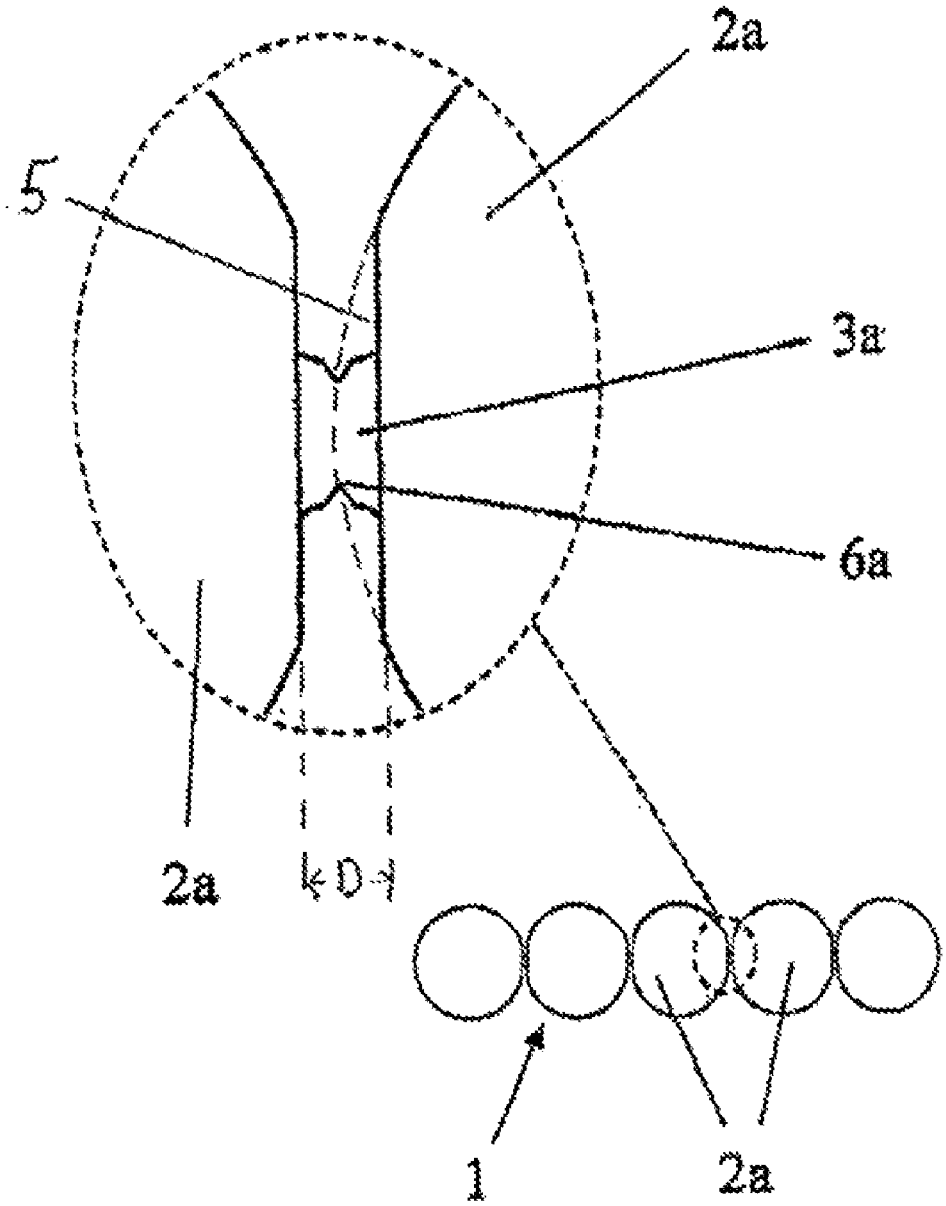
FIG. 5 a portion of the effective body element of FIG. 3.
Figure 6:
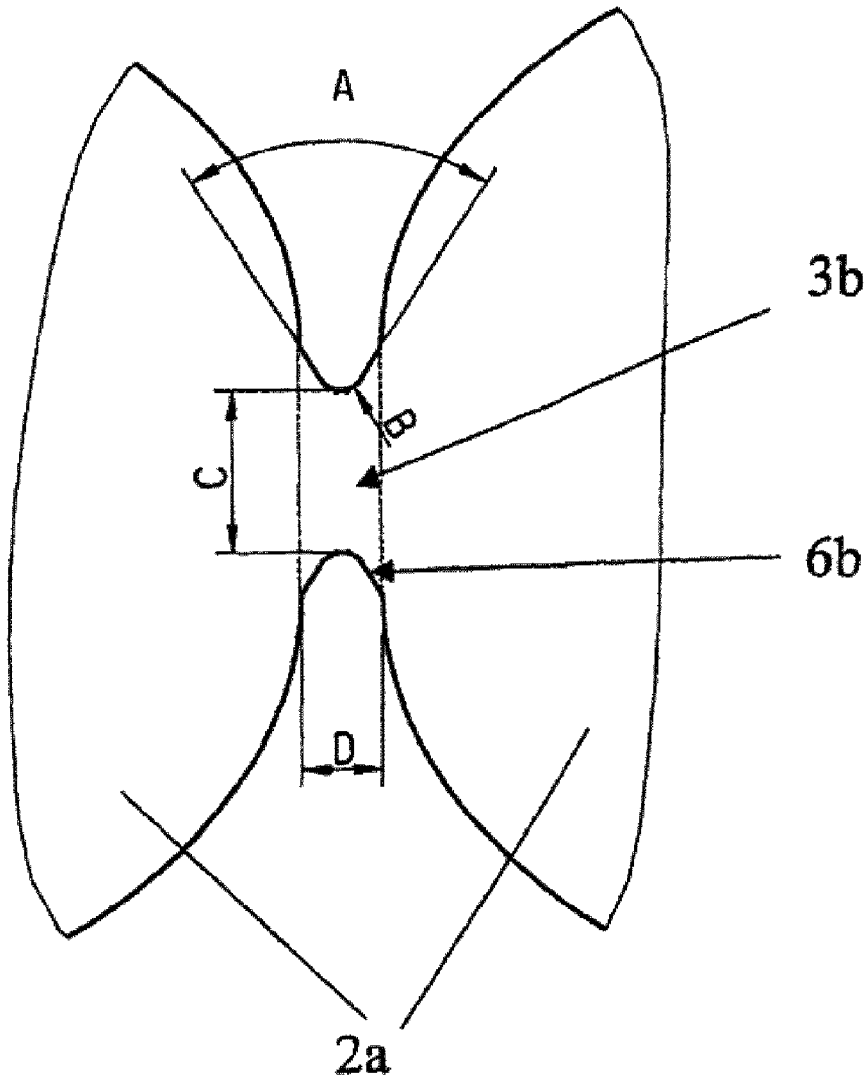
FIG. 6 a modified embodiment of the portion of FIG. 5.

FIG. 5 shows that the webs 3*a* are provided with two notches 6*a* so that during the manufacture the effective body chain can be broken or divided. Pursuant to FIG. 6, the notches 6*b*, having the notch base radius B, can, at a prescribed notch angle A, also extend over the entire web length D, whereby the ratio of the notch base web width C and the web length D ranges from 0.3 to 2.5.

Figure 7:
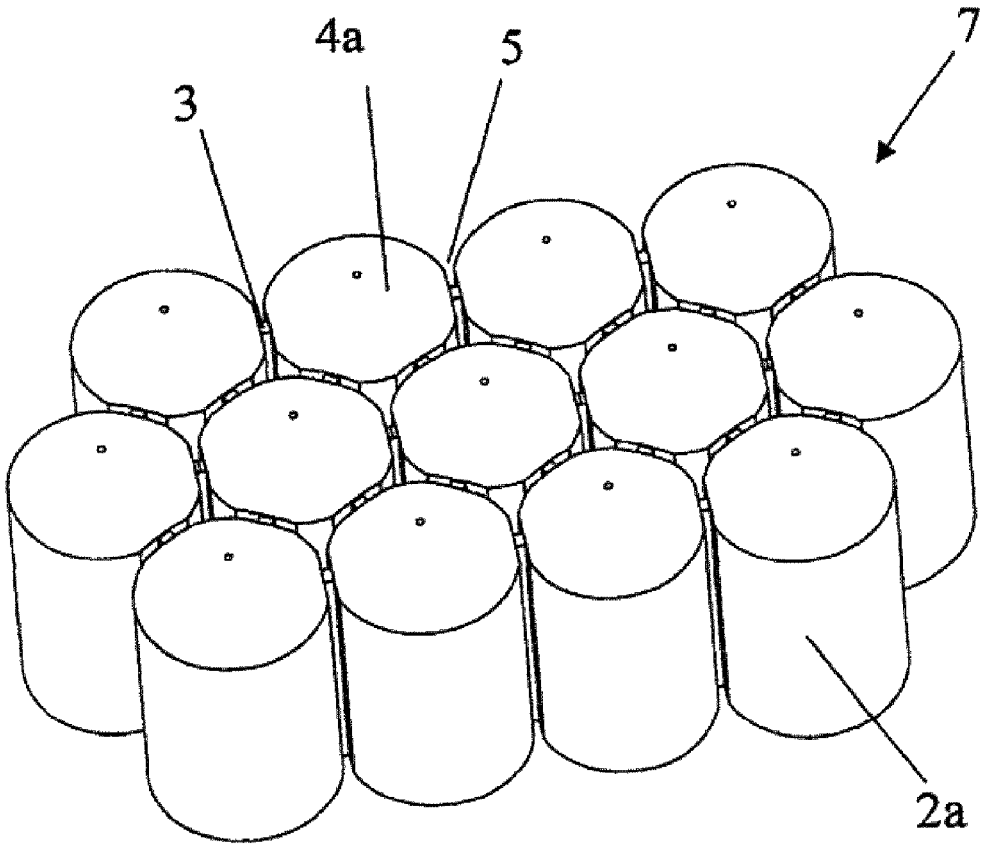
FIG. 7 effective body elements according to FIG. 1 combined to form an effective body matrix.

FIG. 7 shows a monolithically produced effective body matrix 7, according to which the effective bodies 2*a* are interconnected by means of webs 3. Each interior effective body 2*a* is connected with other effective bodies 2*a* via six webs 3. The webs 3 have the previously described break notches 6. The effective bodies 2*a*, which are provided with conical end faces 4*a*, are additionally disposed in such a way as to be offset relative to one another.

Figure 8:
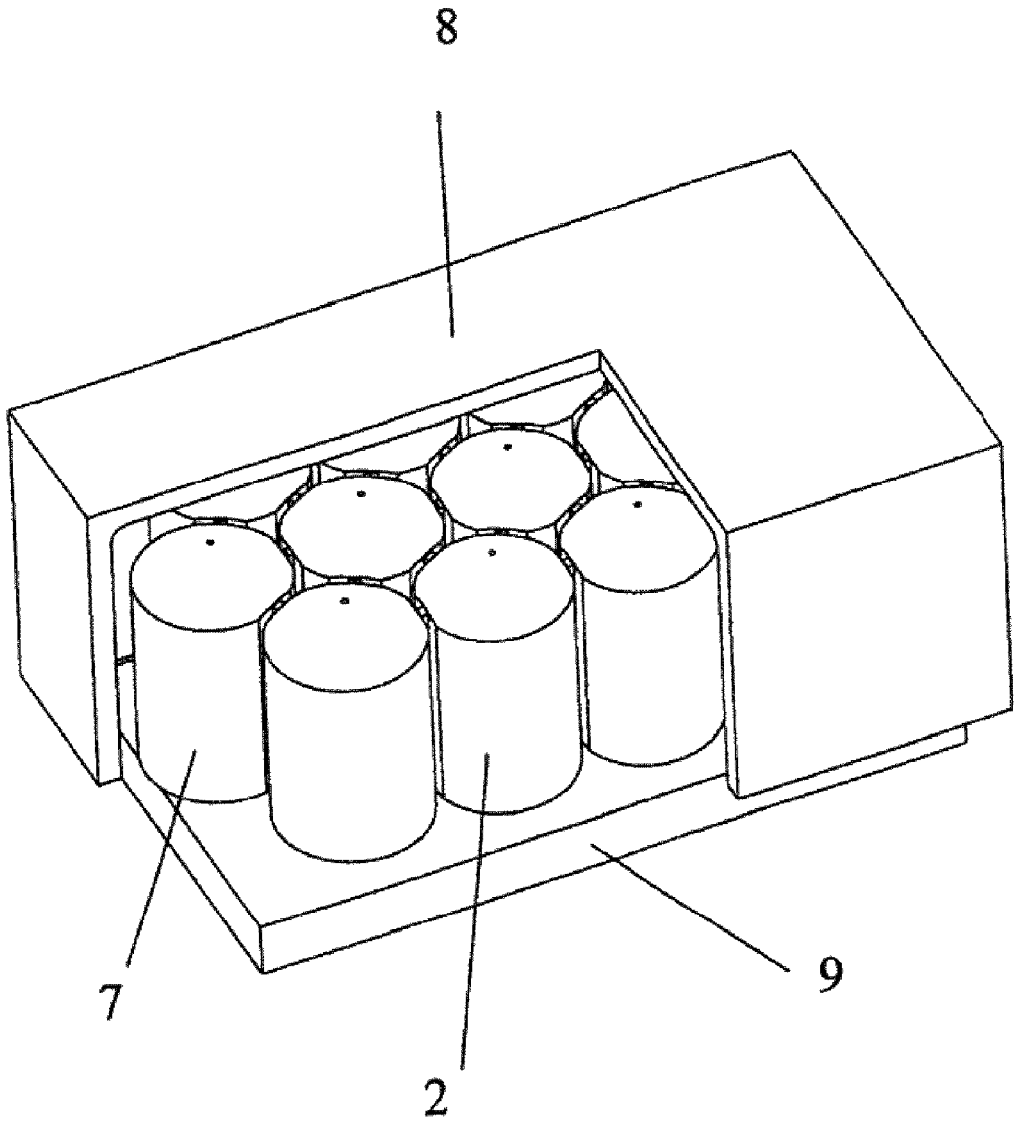
FIG. 8 a composite armor plate with the effective matrix of FIG. 7 disposed in a case.

FIG. 8 shows the arrangement of the effective body matrix 7 in a metal case 8. The case 8 represents the outer protective layer of a composite armor plate, and is cast or adhesively joined to the effective body matrix 7 and a lower end layer 9 of fiber material via a non-illustrated matrix material.

Figure 9:
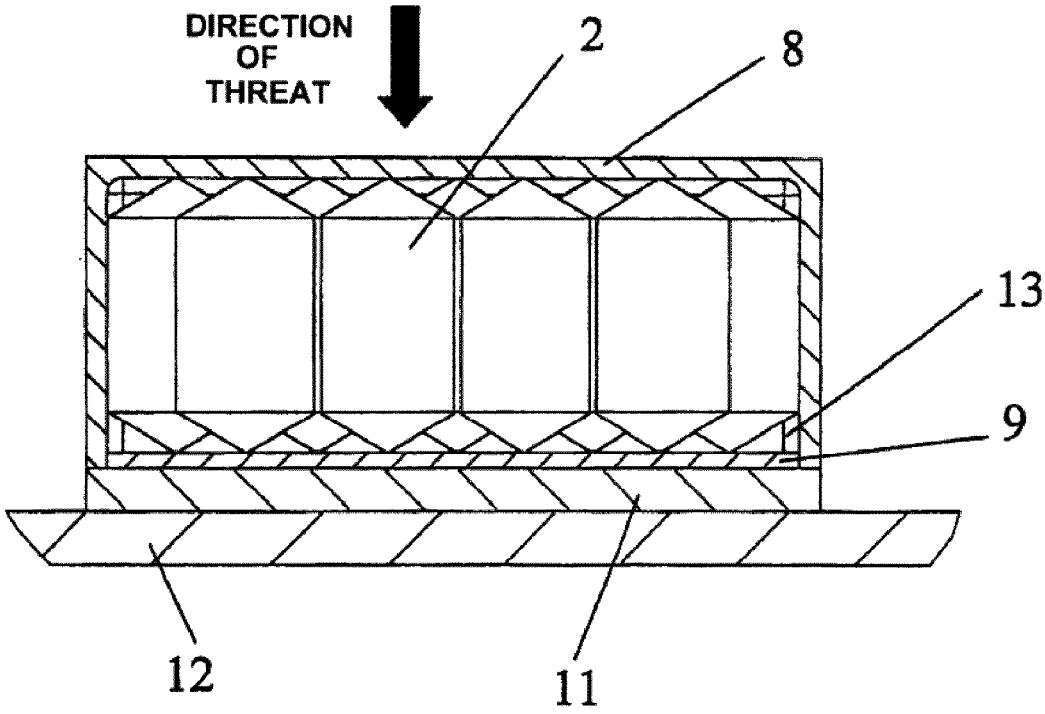
FIG. 9 a cross-section of a composite armor plate placed upon a housing of a combat vehicle.

FIG. 9 shows the arrangement of a composite armor plate as a composite armor element on a metallic housing 12 of an armored combat vehicle. The plate is comprised of the case 8, a matrix material 13 in the form of a casting or adhesive mass, a layer of the extra hard effective body chains 1, and the end layer 9. Disposed between the end layer 9 and vehicle 12 is a dampening elastomer intermediate layer 11. The effective bodies (2) or the matrix material (13) form the end of the composite armor element. The end layer 9 preferably is made of a fiber material, in particular aramid, glass fiber, polyamide or carbon fiber. One side of said composite armor element includes at least one layer made of a shock-absorbing material, in particular of foam materials or elastomers.

The specification incorporates by reference the disclosure of German 10 2006 052 047.0 filed Nov. 10, 2006 and International application PCT/DE2007/001921 filed Oct. 24, 2007.

The present invention is, of course, in no way restricted to the specific disclosure of the specification and drawings, but also encompasses any modifications within the scope of the appended claims.

The invention claimed is:

1. The composite armor element for protection against projectiles, comprising:

at least one layer of effective bodies, wherein said effective bodies are disposed in rows next to one another in said composite armor element, further wherein said effective bodies are embedded in a matrix material, further wherein said effective bodies of a given row of effective bodies are fixedly interconnected at least partially by respective webs to form a chain, and wherein each chain of said effective bodies is a respective monolithic element.

2. The composite armor element according to claim 1, wherein said effective bodies of a given layer of said at least one layer in adjacent rows are fixedly interconnected in a manner resembling a matrix at least partially by webs.

3. The composite armor element according to claim 1, wherein said effective bodies are at least partially cylindrical with a circular or oval cross-section.

4. The composite armor element according to claim 3, wherein at least one end face of said effective bodies has a conical configuration, in particular with a rounded apex.

5. The composite armor element according to claim 1, wherein said effective bodies have an at least partially spherical configuration.

6. The composite armor element according to claim 1, wherein said effective bodies are at least partially rod-shaped with a polygonal cross-section.

7. The composite armor element according to claim 6, wherein at least one end face of said effective bodies has a pyramidal configuration, in particular with a rounded apex.

8. The composite armor element according to claim 1, wherein at least one end face of the effective bodies has a convex configuration.

9. The composite armor element according to claim 1, wherein said effective bodies at least partially have a ratio between height of said effective bodies and maximum width dimension of said effective bodies that is greater than 0.8.

10. The composite armor element according to claim 1, wherein a ratio of a minimum web width to a maximum main dimension of a cross-section of said effective bodies is less than 0.4.

11. The composite armor element according to claim 1, wherein each of said webs is at least partially provided with a notch.

12. The composite armor element according to claim 11, wherein each said notch extends over an entire length of a respective one of said webs.

13. The composite armor element according to claim 11, wherein each said notch forms a notch angle that is in the range of 40° to 100°.

14. The composite armor element according to claim 11, wherein a ratio of a web width at a base of each said notch the notches and web length is in the range of from 0.3 to 2.5.

15. The composite armor element according to claim 11, wherein said effective bodies are provided at least partially in the region of the web connections with cutouts that correspond to half of a web length.

16. The composite armor element according claim 1, wherein one side of said composite armor element includes at least one layer made of a fiber material, in particular aramid, glass fiber, polyamide or carbon fiber.

17. The composite armor element according to claim 1, wherein one side of said composite armor element includes at least one layer made of a shock-absorbing material, in particular of foam materials or elastomers.

18. A composite armor element according to claim 1, wherein said effective bodies are comprised at least partially of ceramic materials, in particular at least partially of aluminum oxide ceramic having an $Al_2O_3$ content of 92%-99.99%.

19. The composite armor element according to claim 1, wherein said effective bodies are comprised at least partially of boron carbide, silicon carbide, silicon nitrite, or titanium triborate, or at least partially of sintered materials or of metallic materials, in particular hardened steel, aluminum or titanium.

20. The composite armor element according to claim 1, wherein said effective bodies form an end of said composite armor element.

21. A composite armor element according to claim 1, wherein said effective bodies are disposed parallel to one another.

22. The composite armor element according to claim 1, wherein said effective bodies are disposed upright.

23. The composite armor element according to claim 1, wherein said effective bodies within a given layer of effective bodies are disposed at least partially offset to effective bodies in adjacent rows.

24. The composite armor element according to claim 1, which includes a case, in particular of steel, light metal, polymeric material or fiber composite material, wherein said effective bodies are disposed within said case, and wherein said case in particular represents at least one end layer of said composite armor element.

25. Effective body elements (1) for insertion in a composite armor element, each of said effective body elements comprising:

at least two effective bodies, wherein said effective bodies are respectively fixedly interconnected by at least one web to form a chain, further wherein said effective body elements are monolithic elements.

26. The effective body elements according to claim 25, wherein said effective bodies are fixedly interconnected by said webs to form a matrix.

27. The effective body elements according to claim 25, wherein a ratio of a minimum web width to a maximum main dimension of a cross-section of said effective bodies is less than 0.4.

28. The effective body elements according to claim 25, wherein said webs are provided at least partially with a notch.

29. The effective body elements according to claim 28, wherein said notch extends over the entire web length.

30. The effective body elements according to claim 28, wherein said notches form a notch angle that ranges from between 40° to 100°.

31. The effective body elements according to claim 28, wherein a ratio of a web width at a base of said notches and a web length ranges from 0.3 to 2.5.

32. The effective body elements according to claim 28, wherein said effective bodies are provided at least partially with cutouts in the region of the web connections, and wherein said cutouts correspond to half of a web length.

* * * * *

UNITED STATES PATENT AND TRADEMARK OFFICE

CERTIFICATE OF CORRECTION

PATENT NO. : 8,065,946 B2
APPLICATION NO. : 12/513153
DATED : November 29, 2011
INVENTOR(S) : Weber et al.

It is certified that error appears in the above-identified patent and that said Letters Patent is hereby corrected as shown below:

Title page Item (54) and Col. 1 line 1 & 2
The title currently reads incorrectly as:
Composite Armor Element and Effective Body Element Title should actually correctly read as:
Composite Armor Element & Effective Body Element For Insertion in a Composite Armor Element Signed and Sealed this
Third Day of April, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,065,946 B2
APPLICATION NO. : 12/513153
DATED : November 29, 2011
INVENTOR(S) : Jürgen Weber It is certified that error appears in the above-identified patent and that said Letters Patent is hereby corrected as shown below:

Item (73) Assignee: should read:

Krauss-Maffei Wegmann GmbH & Co. KG

Signed and Sealed this
Twenty-second Day of January, 2013

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,065,946 B2
APPLICATION NO. : 12/513153
DATED : November 29, 2011
INVENTOR(S) : Jürgen Weber et al.

It is certified that error appears in the above-identified patent and that said Letters Patent is hereby corrected as shown below:

Title Page,

Item [73], Assignee, "Krauss-Maffei Wegmann GmbH & Co. KG" (as corrected to read in the Certificate of Correction issued January 22, 2013) is deleted and assignee is reinstated to read -- Krauss-Maffei GmbH &Co. --.

Signed and Sealed this
Nineteenth Day of March, 2013

Teresa Stanek Rea
*Acting Director of the United States Patent and Trademark Office*